United States Patent [19]

Bruni et al.

[11] 4,426,207

[45] Jan. 17, 1984

[54] STABLE TERNARY CRYOGENIC FUEL HAVING DENSITY IN THE GASEOUS STATE LESS THAN THAT OF AIR

[75] Inventors: Maurice Bruni, Tremblay-les-Gonesse; George Duboz, Paris, both of France

[73] Assignee: L'Air Liquide-Societe Anonyme pour l'Etude et l'Exploitation des Procedes Georges Claude, Paris, France

[21] Appl. No.: 353,209

[22] Filed: Mar. 1, 1982

[51] Int. Cl.[3] ..... C10L 1/00

[52] U.S. Cl. ..... 44/50; 44/52

[58] Field of Search ..... 44/52, 50; 48/197 FM

[56] References Cited

U.S. PATENT DOCUMENTS

| | | | |
|---|---|---|---|
| 1,096,797 | 5/1914 | Snelling | 206/0.7 |
| 1,528,765 | 3/1925 | Harris | 48/197 FM |
| 3,713,793 | 1/1973 | Maruyama et al. | 44/52 |
| 3,796,554 | 3/1974 | Meinass | 48/197 FM |
| 4,045,189 | 8/1977 | Bruni et al. | 44/52 |

FOREIGN PATENT DOCUMENTS

| | | | |
|---|---|---|---|
| 476342 | 3/1937 | United Kingdom | 48/197 FM |

*Primary Examiner*—Anton H. Sutto
*Assistant Examiner*—Y. Harris-Smith
*Attorney, Agent, or Firm*—Browdy and Neimark

[57] ABSTRACT

A stable cryogenic fuel mixture containing 25 to 30% by volume of acetylene, 61 to 72% by volume of ethylene and 3 to 9% by volume of a $C_3$ hydrocarbon preferably propylene. This fuel mixture having a density in the gaseous state, which is less than the density of air, is particularly suited for use in welding and assembly operations.

8 Claims, 2 Drawing Figures

STABLE TERNARY CRYOGENIC FUEL HAVING DENSITY IN THE GASEOUS STATE LESS THAN THAT OF AIR

FIELD OF THE INVENTION

The invention relates to a stable cryogenic ternary fuel having a density in the gaseous state, which is less than the density of air.

BACKGROUND OF THE INVENTION

It has been a practice, for more than half a century, to use acetylene as a fuel in this technical field. However, the nature of acetylene makes it very dangerous to keep it compressed in the natural state, and currently it is stored in a porous material, after have having been compressed and dissolved in a solvent, such as acetone. Under these conditions, the weight of acetylene stored or shipped is slight in relation to the weight of the container and its contents.

Shipping and storage of acetylene in the liquid state has been considered, but because of the risk of explosion and the difficulty in handling, pure liquified acetylene is not used.

Use of mixture of acetylene has been proposed, thus avoiding the risks of explosion and making it possible to obtain a combustion temperature high enough to perform welding and oxygen cutting operations. On the other hand, it is known that addition of acetylene in a fuel gas can impart to the latter welding performances resembling those of acetylene. Now, although it is easy to make up gaseous mixtures having a constant composition, such is not the case when the mixture is stored in the liquid state where the gaseous phase is different, in chemical composition, from the liquid phase. In the case of an ethylene-acetylene mixture, an enrichment in acetylene content occurs, while in the case of a propylene-acetylene mixture there is an impoverishment in acetylene content, which after a certain time results in a mixture which is unsuitable for welding.

This difficulty can be avoided by removal of the liquid phase from the mixture, the content of which remains constant to the extent that the liquid is not heated at high temperature or for long periods of time.

Generally in industry, heating of the liquid cannot be avoided and it is necessary to relieve the excess pressure which creates a modification of the mixture content. This phenomenon is very important when insulation of the container is poor or when the cryogenic container is stored too long.

For several years an effort has been made to find combustible mixtures having a fairly constant acetylene content, which do not require special equipment for its distribution as a liquid, as is the case for ethyleneacetylene mixtures.

Mixtures have been found that are distributable in liquid form using standard cryogenic liquid equipment and the gaseous phase and liquid phase of which have a fairly constant acetylene content. These combustible fuel gaseous mixtures, obtaied by natural evaporation of the liquid phase, without removal of the latter, represent a saving in investment for the user because of a simplification of the equipment in relation to the use of binary ethylene-acetylene mixtures as fuels.

With known ethylene-acetylene mixtures, there is preferred evaporation of the ethylene compound and consequently an acetylene content enrichment of the liquid phase occurs. Proposed ternary mixtures that do not exhibit acetylene enrichment in the liquid phase are less explosive and therefore meet safety standards better.

SUMMARY AND OBJECTS OF THE INVENTION

Mixtures of two hydrocarbons and acetylene have been obtained which by natural evaporation, result in a gaseous mixture, the acetylene content of which varies only slightly; therefore a standard cold evaporator is used which permits simultaneous removal of the liquid and gaseous phases, thereby producing a three-constituent mixture in which one constituent is more volatile than acetylene, while the thin constituent is less volatile. This last constituent, by physical effect, contributes to the stabilization of the liquid phase content at the end of emptying, while the more volatile constituent stabilizes the gaseous phase content at the beginning of emptying.

The second constituent selected to be more volatile than acetylene is ethylene.

The third constituent selected to cause stabilization of the liquid phase is a hydrocarbon the molecule of which contains three carbon atoms, said hydrocarbon belonging to the group comprising propane, cyclopropane and propylene; the choice of this third constituent is preferably the unsaturated hydrocarbon, namely propylene.

Further, to meet particular safety standards for all operations, which are performed in small spaces and shops having a confined atmosphere, which are below ground and at times difficult to ventilate, an effort has been made to find fuel mixtures useful for welding and assembly applications, where the density of such fuel mixtures, in the gaseous state, is less than that of air.

According to the invention, the cryogenic ternary fuel, consisting of a mixture of acetylene, ethylene and a $C_3$ hydrocarbon in the following proportions: 25 to 30% by volume of acetylene, 61 to 72% by volume of ethylene and 3 to 9% by volume of a $C_3$ hydrocarbon, is used in the gaseous state after vaporizing of the mixture which is stored in the liquid state.

This combustible mixture is particularly suited for use in welding and assembly operations.

The density of the fuel mixture in the gaseous state is always less than that of air, even when there is alternating removal of the gaseous phase from the storage tank or vaporizing of the liquid, under normal working conditions, i.e., when, to the greatest extent possible, the ratio of the amount removed in the gaseous phase to that of the amount removed from the liquid phase is less than 1.

The stability of the above combustible mixture is suited for industrial use in large amounts as a fuel.

The slight acetylene content enrichment during slow evaporation allows said mixtures to be distributed in bulk or in small standard cryogenic evaporators, free of copper or copper alloys.

Shipping and container-to-container transfer are performed more advantageously, the product being stored in the liquid phase. It is possible to consider packaging the gaseous phase in the compressed state, under a pressure that can reach 100 bars, in containers filled with porous material.

DETAILED DESCRIPTION OF PREFERRED EMBODIMENTS

Figure 1:
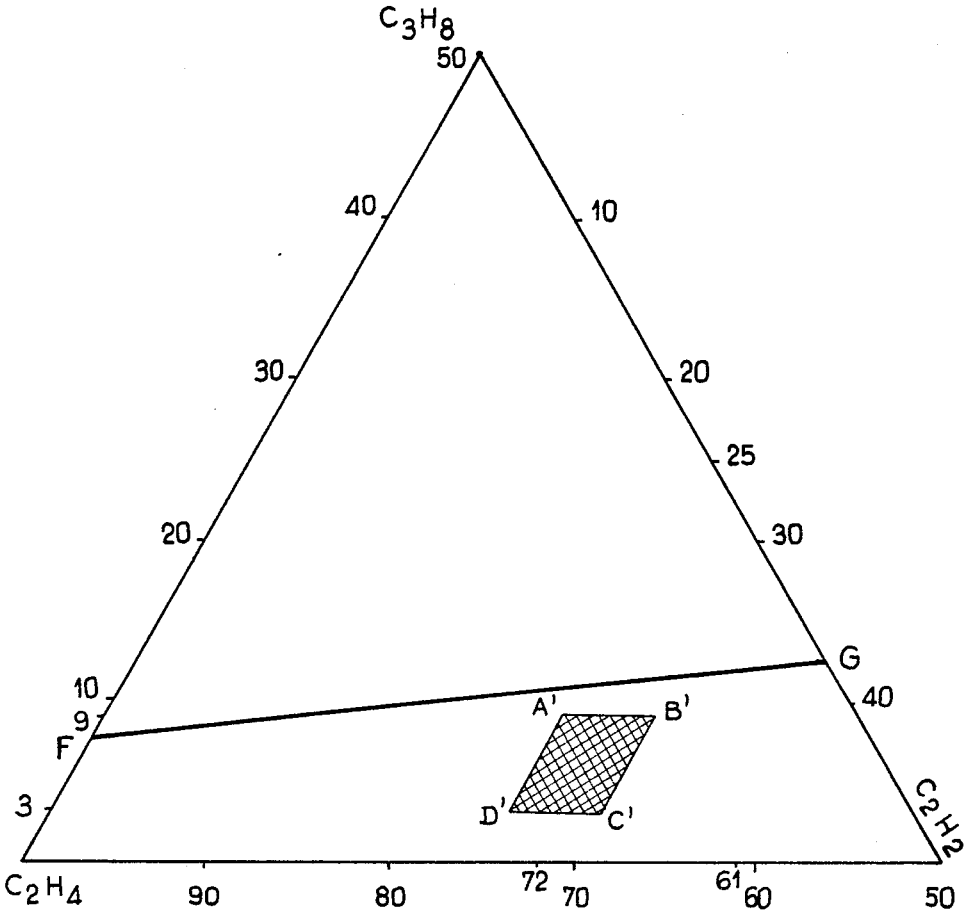
FIG. 1 is a ternary diagram of the fuel mixtures of the invention.

The combustion mixtures of the invention, when the $C_3$ hydrocarbon is propylene, are shown in the attached ternary diagram of FIG. 1. The acetylene, ethylene and propylene are plotted in percentages by volume. The properties of density of the fuel mixture in the gaseous phase, which is less than air, and of slight acetylene enrichment content are maintained perfectly in the quadrilateral A'B'C'D', located below straight line FG representing mixtures having a density equal to air.

The preferred range of use corresponds to a cryogenic mixture containing about 26% acetylene, about 69% ethylene and about 5% propylene.

A nonlimiting example illustrating the invention is given below.

EXAMPLE

| | Initial composition E |
|---|---|
| acetylene | 26% |
| ethylene | 69% |
| propylene | 5% |

Use of this mixture in standard evaporators, from which it is possible to remove the liquid phase and gaseous phase as a function of the increase of the tank pressure, gives rise to modification of the following compositions:

| | gaseous phase | | | liquid phase | | |
|---|---|---|---|---|---|---|
| emptying weight | acetylene | ethylene | propylene | acetylene | ethylene | propylene |
| starting | 21.0 | 77.0 | 2.0 | 26.0 | 69.0 | 5.0 |
| 20% | 21.5 | 76.5 | 2.0 | 26.5 | 68.0 | 5.5 |
| 40% | 22.0 | 75.5 | 2.5 | 27.0 | 67.0 | 6.0 |
| 60% | 22.5 | 74.5 | 3.0 | 27.5 | 63.5 | 9.0 |

-continued

| | gaseous phase | | | liquid phase | | |
|---|---|---|---|---|---|---|
| emptying weight | acetylene | ethylene | propylene | acetylene | ethylene | propylene |
| 80% | 24.0 | 72.5 | 3.5 | 29.5 | 59.5 | 11.0 |

Figure 2:
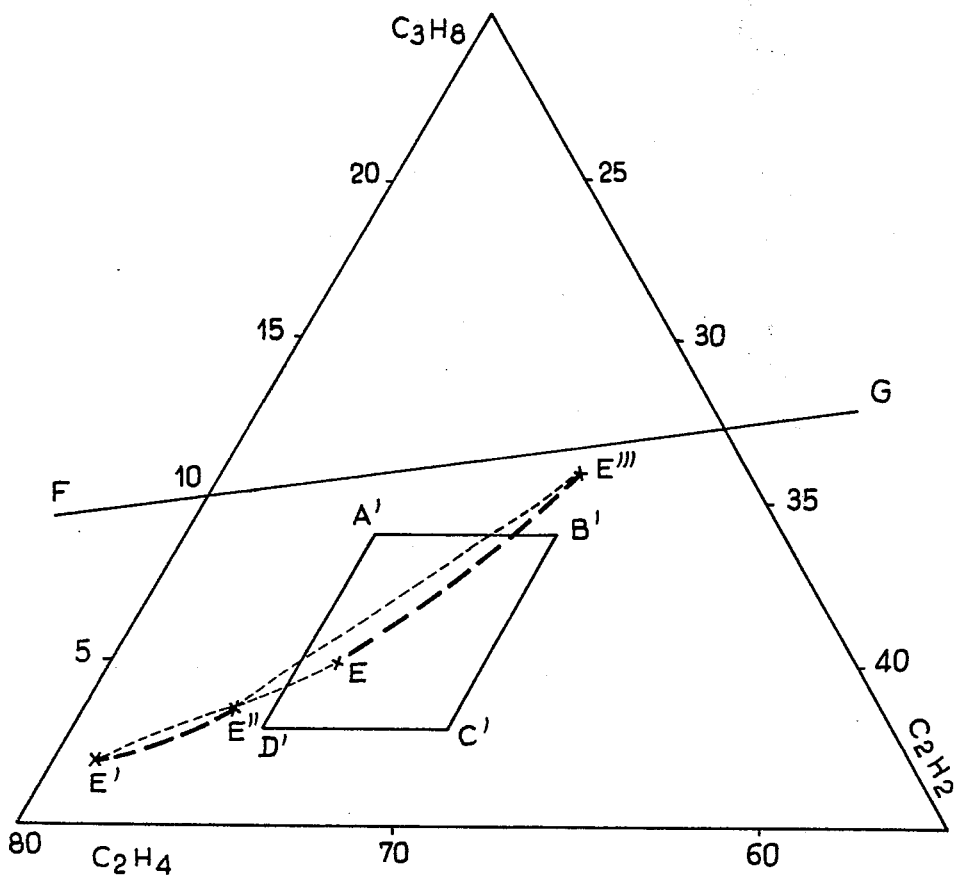
FIG. 2 is an enlarged view of a portion of the ternary diagram of FIG. 1.

In any case, it is seen in FIG. 2 that the group of points showing the liquid and gaseous compositions are below straight line FG in the accompanying drawing. Broken line EE''' shows the evolution of the liquid phase while broken line E'E'' corresponds to that of the gaseous phase. The original cryogenic mixture is represented by point E, conjugate point E' representing the composition of the gaseous phase in equilibrium with E; points E'' and E''' respectively representing the compositions of the gaseous phase and liquid phase at 80% of emptying.

We claim:

1. Stable cryogenic ternary fuel having a density in the gaseous state less than that of air, consisting of a mixture of acetylene, ethylene and a hydrocarbon containing three carbon atoms in its molecule, wherein said initial cryogenic mixture contains 25 to 30% by volume of acetylene, 61 to 72% by volume of ethylene and 3 to 9% by volume of the $C_3$ hydrocarbon.

2. Ternary fuel according to claim 1, wherein the hydrocarbon containing three carbon atoms is selected from the group consisting of propane, cyclopropane and propylene.

3. Ternary fuel according to claim 1, wherein the $C_3$ hydrocarbon is propylene.

4. Ternary fuel according to claim 3 wherein the initial cryogenic mixture contains about 26% acetylene, about 69% ethylene and about 5% propylene.

5. Ternary fuel according to any one of claims 1 to 4, wherein said fuel in the refrigerated liquid state.

6. Ternary fuel according to any of claims 1 to 4, wherein said fuel is in the compressed gaseous state under pressure of up to 100 bars in containers filled with a porous material.

7. A cryogenic storage container containing a refrigerated liquid ternary fuel in accordance with claim 5.

8. A pressurized container containing a porous material and filled with a compressed gaseous ternary fuel in accordance with claim 6.

* * * * *